US005123607A

United States Patent [19]

Jones

[11] Patent Number: 5,123,607

[45] Date of Patent: Jun. 23, 1992

[54] AUTOMATIC WIRE DISPENSER

[76] Inventor: Johnnie L. Jones, 5600 - 10 Mile Rd., NE., Rockford, Mich. 49341-9552

[21] Appl. No.: 549,276

[22] Filed: Jul. 6, 1990

[51] Int. Cl.[5] ..... B65H 23/185; B65H 59/38

[52] U.S. Cl. ..... 242/78; 242/45; 242/75.51; 242/105

[58] Field of Search ..... 242/78, 105, 54 R, 45, 242/75.42, 75.43, 75.44, 75.5, 75.51, 78.6, 78.7

[56] References Cited

U.S. PATENT DOCUMENTS 4,555,071 11/1985 Nordlof ..... 252/105 X
4,582,271 4/1986 Takahashi ..... 242/105 X
4,899,945 2/1990 Jones ..... 242/78 X

*Primary Examiner*—John M. Jillions
*Attorney, Agent, or Firm*—Price, Heneveld, Cooper, DeWitt & Litton

[57] ABSTRACT

The invention relates to a variable speed, motorized wire dispenser which automatically dispenses wire to a wire using machine under variable wire feed rate conditions. The dispenser includes a support means for a coil of wire, an electric motor to rotate the coil of wire, a motor controller for controlling the operation of the motor, a wire accumulation device having a wire engaging guide mounted at one end of a movable arm and biased to increase the accumulation loop between predetermined limits, and a control potentiometer responsive to the position of the guide to generate a control signal which is transmitted to the controller. The potentiometer is rotated by a drive belt wrapped around a drive sprocket attached to the output shaft of the potentiometer. The belt has one end attached to the frame of the dispenser through a resilient tension spring and has another end attached to the movable arm. A stop member in the form of an adjustable clip mounted on the belt stops movement of the belt over the potentiometer to limit rotation of the potentiometer to a predetermined maximum amount indicative of the highest wire feed rate desired.

3 Claims, 7 Drawing Sheets

AUTOMATIC WIRE DISPENSER

BACKGROUND OF THE INVENTION

The present invention relates to automatic wire dispensing machines and more particularly to an automatic wire dispensing machine that is capable of dispensing wire from a large spool or coil or the like under demanding conditions of use that include high rates of wire feed and intermittent and sporadic feed requirements. Such demanding uses are typical in wire spring forming machines and to a certain extent in automatic welding machines that use welding wire as a source of the metal forming the weld bead.

Many industrial operations require a substantially continuous supply of metal wire. An automatic spring making machine is one type of operation, and an automatic welding machine employing wire to form the weld bead is another type of operation. For exemplary purposes, the present invention will be described in connection with these types of operations, although it can be used in other types of operations as well.

In operations requiring a continuous supply of metal wire, the wire can be provided in a number of forms. It can be wound on a wooden spool or it can be packaged in a drum or loosely in a coil. The wire can be mounted for rotation and dispensation about a vertical or horizontal axis.

In order to maximize the efficiency of wire feeding operations, it is desirable to employ supply wire in large quantities; for example, a wire spool weighing up to one thousand (1,000) pounds or more is common. A large supply of wire minimizes the number of times that the spool has to be changed and handled and can provide efficiencies in purchasing the wire in larger bulk quantities.

Large spools of wire present special problems. Because of the inertia of a full spool, a substantial amount of force is required to start the spool rotating, and when wire usages stops, the inertia of the spool causes the spool to continue rotating and continue feeding wire. When relatively thin wire is coiled on a large spool, the problems are especially acute. A sudden start of the spool can break the wire. Moreover, excess tension in the wire can stretch it to the point of "necking down" to a reduced diameter and correspondingly reduce the diameter of the metal available for the metal forming operation. When a particular diameter of wire is accurately predetermined, it is undesirable to stretch the wire so that an inconsistently thinner wire is actually available for the operation.

Another problem with requiring a large pulling force to remove wire from a supply spool is that the wire can be wedged between adjacent coils on the spool and can become gripped tightly enough to resist pulling free of the spool. Further, the drive mechanism for the metal forming operation needs to grip the wire tightly in order to overcome the inertia of the spool, and in so doing the teeth of the drive mechanism can bite into the wire and affect the characteristics of the wire.

Still another problem with the use of a large wire supply spool is that the weight of the spool changes markedly as wire is withdrawn from the spool, reducing the weight of a fully loaded spool from one thousand (1,000) pounds to as little as thirty (30) pounds when the spool is empty. This presents a changing inertia force that affects the starting and stopping characteristics of the spool.

A number of machines have been developed to overcome these problems, but none have been completely successful. Most such machines employ some type of motorized mechanism for supplying the wire and a mechanical brake mechanism for stopping the spool when the wire supply is no longer required. Some machines provide tension control devices that are intended to match the feed rate with the utilization rate. Other machines provide slack wire loops that permit the machine using the wire to make rapid and intermittent use of the wire while providing the wire feed at a more continuous rate. Such machines often require frequent adjustment to accommodate different sizes of wires, different feed rates, different spool sizes, and changing spool weights and diameters due to the removal of wire form, the spools. Even with continuous changes, such machines still are usually not capable of consistent and reliable performance.

It is an object of the present invention to provide an improved automatic motorized wire dereeler or dispenser that is simple to operate, compact, inexpensive, and accommodates a wide range of operating conditions without adjustment.

SUMMARY OF THE INVENTION

In accordance with the present invention a variable speed, motorized wire dispenser for automatically dispensing wire from a coil of wire to a wire using machine under variable wire feed rate conditions comprises a frame that rotatably supports a coil of wire; an electric motor that rotates the coil of wire; a motor controller that controls the operation of the electric motor; a wire accumulation mechanism comprising a movable wire that produces an accumulation loop in the wire; and a control mechanism that generates a continuously variable electric control signal representative of guide position. The control signal is being transmitted to the motor controller so as to produce a change in motor speed, the control mechanism causing the motor to decrease the rate of wire feed as wire supply requirements decrease and increase the rate of wire feed as wire supply requirements increase. The control mechanism comprises a rotary potentiometer having an output shaft, with a drive sprocket being mounted on the output shaft, the potentiometer being rotated to change the control signal. The potentiometer is rotated by a drive belt wrapped at least partially around the drive sprocket, the belt having one end attached to the frame through a resilient tension device and having another end attached to the arm. The end attached to the arm is mounted such that the arm releases tension on the belt as the arm moves to a position indicative of a smaller accumulation loop, the resilient tension device pulling the belt over the potentiometer sprocket in such a manner as to increase speed when tension is released in such manner. A stop mechanism or obstruction is mounted on the belt for stopping movement of the belt over the potentiometer so as to limit the rotation of the potentiometer to a predetermined maximum amount indicative of the highest wire feed rate desired. Further arm movement in the direction of a decreasing loop produces no further belt induced potentiometer rotation and consequently no further motor speed increase after the belt movement has been stopped by the stop means.

Other features of the invention include a spring biased feed pulley, a limit switch with a spring biased delay actuator, a small wire dispenser with a potentiometer with integral bearings, a flat wire dispenser, a loose wire hold-down ring, an improved spring counterbalance for the dancer arm, and an adjustable height pulley support. Other features are apparent from the following description of preferred embodiments of the invention.

DETAILED DESCRIPTION OF PREFERRED EMBODIMENTS

Figure 1:
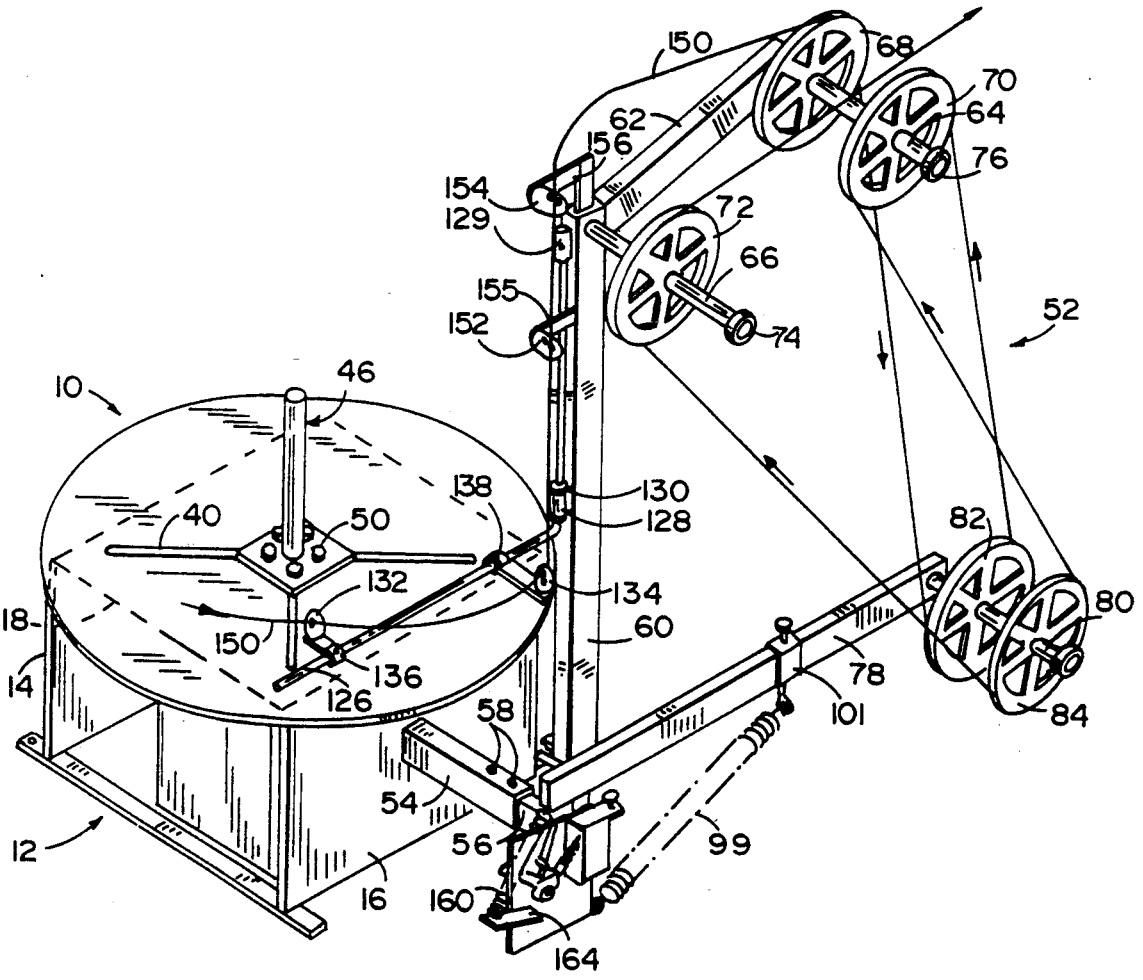
FIG. 1 is a perspective view of a wire dispenser of the present invention.

Referring to the drawings, wire dereeler 10 comprises a base 12 having spaced vertical sides 14 and 16, with a top 18 extending between the sides. The top has an opening 20 therethrough for the drive mechanism. A one-half (½) horse power D.C. drive motor 24 is bolted in the interior of the housing in slots 26 in vertical sidewall 14. The slots permit horizontal adjustment of the drive motor position. A regenerative motor controller 15 of the same type disclosed in U.S. Pat. No. 4,899,945 (which is incorporated by reference) is attached to the housing. The controller includes a manually adjustable trim potentiometer 17, which controls the incremental and maximum amount of the controlled power supply voltage available for the D.C. motor. This makes it possible to vary the incremental and maximum motor speeds over a given range of movement of the dancer of the accumulation device of the invention. This provides an important sensitivity adjustment for the product.

A right angle gear mechanism and drive sprocket 28 are attached to the output shaft of the drive motor. The drive sprocket 28 drivingly engages a drive sprocket 30 having an output drive shaft 34 that extends through opening 20. A table bearing 32 is bolted to the top of the housing over opening 20, such that the drive shaft 34 driven by the drive sprockets extends through the table bearing. The table bearing can be a conventional automobile wheel bearing. A round table 36 driven by shaft 34 is mounted on bolts 38 extending upwardly from the table bearing. Four radial slots 40 extend outwardly in the table from the center at spaced intervals about the table. Spacers 42 properly space the table above the table bearing.

When a spool of wire is placed on the table, a central table stem 44 comprising a flat base 46 and a vertical axle shaft 48 is mounted on the top of the table. The stem is attached to the table and bearings by bolts 38 and nuts 50 (FIG. 1). A spool of wire is laid flat on the stem and is rotated by the table. This can be a counterclockwise or clockwise direction (FIG. 1 orientation), as controlled by a forward and reverse switch on the controller.

Wire is dispensed from the spool through a wire accumulation mechanism 52. Wire accumulation mechanism 52 is mounted on a support beam 54 extending outwardly from the side of the housing. The support beam is a hollow, rectangular beam. The support beam is extendable by a telescoping beam 56 mounted in the end of beam 54. Set screws 58 hold the support beam in any desired position. The telescoping mounting beam is provided so that the wire accumulation mechanism does not interfere with wire spools or other containers that may be of an unusually large diameter.

A vertical support arm 60 is attached to the outer end of beam 56 and extends upwardly to an upper end. An outwardly and upwardly inclined arm 62 is attached to the upper end of arm 60. Axles 64 and 66 are mounted at the outer and inner ends of arm 62, and reels or pulleys 68, 70 and 72 are mounted rotatably on the axles, secured on the axles by collars 74 and 76.

A lower pivotable arm or dancer arm 78 extends outwardly from a lower position on arm 60, and a single axle 80 extends outwardly from the outer end 102 of lower arm 78. Pulleys or reels 82 and 84 are mounted on the axle 80 and secured in place by collar 86. The arm 78 is mounted on support arm 60 by an axle bolt 110 positioned inward of inner end 100 of the arm, with end 100 extending to the left of the axle bolt in FIG. 1 orientation.

An important feature of the present invention is an improved wire feed control mechanism 89 that transmits a control signal to the motor controller in order to vary the speed of the D.C. motor in accordance with the amount of wire present on the accumulation device. The wire feed control mechanism generates a continuously variable electrical control signal representative of the position of lower pivotable arm 78, with the control signal changing gradually as the loop size increases and decreases. The control signal is transmitted to the regenerative motor controller and this produces a change in motor speed. The motor speed decreases as the accumulation increases, and the motor speed increases as the accumulation loop decreases.

Figure 1A:
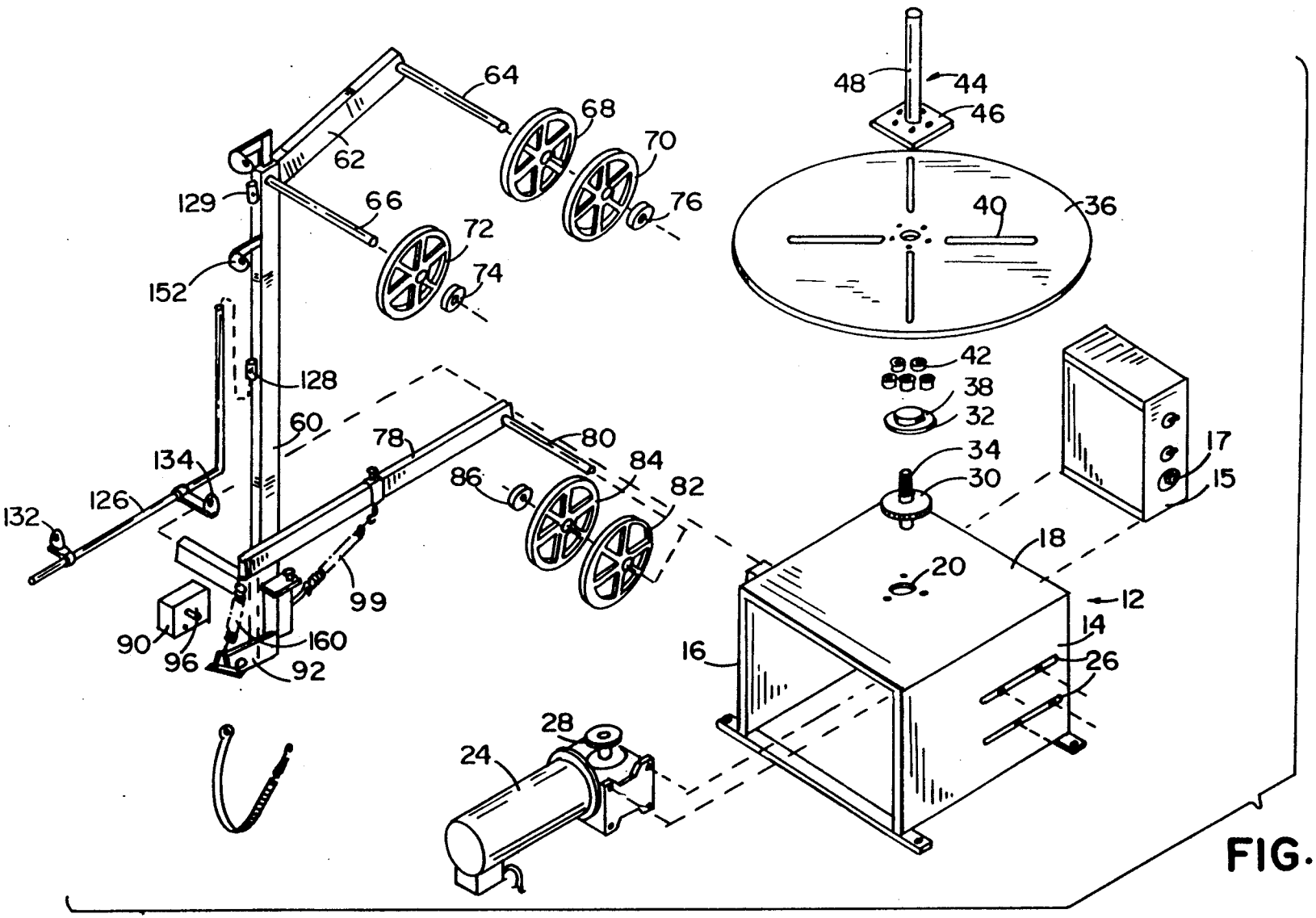
FIG. 1A is an exploded perspective view of the wire dispenser of FIG. 1.
Figure 2:
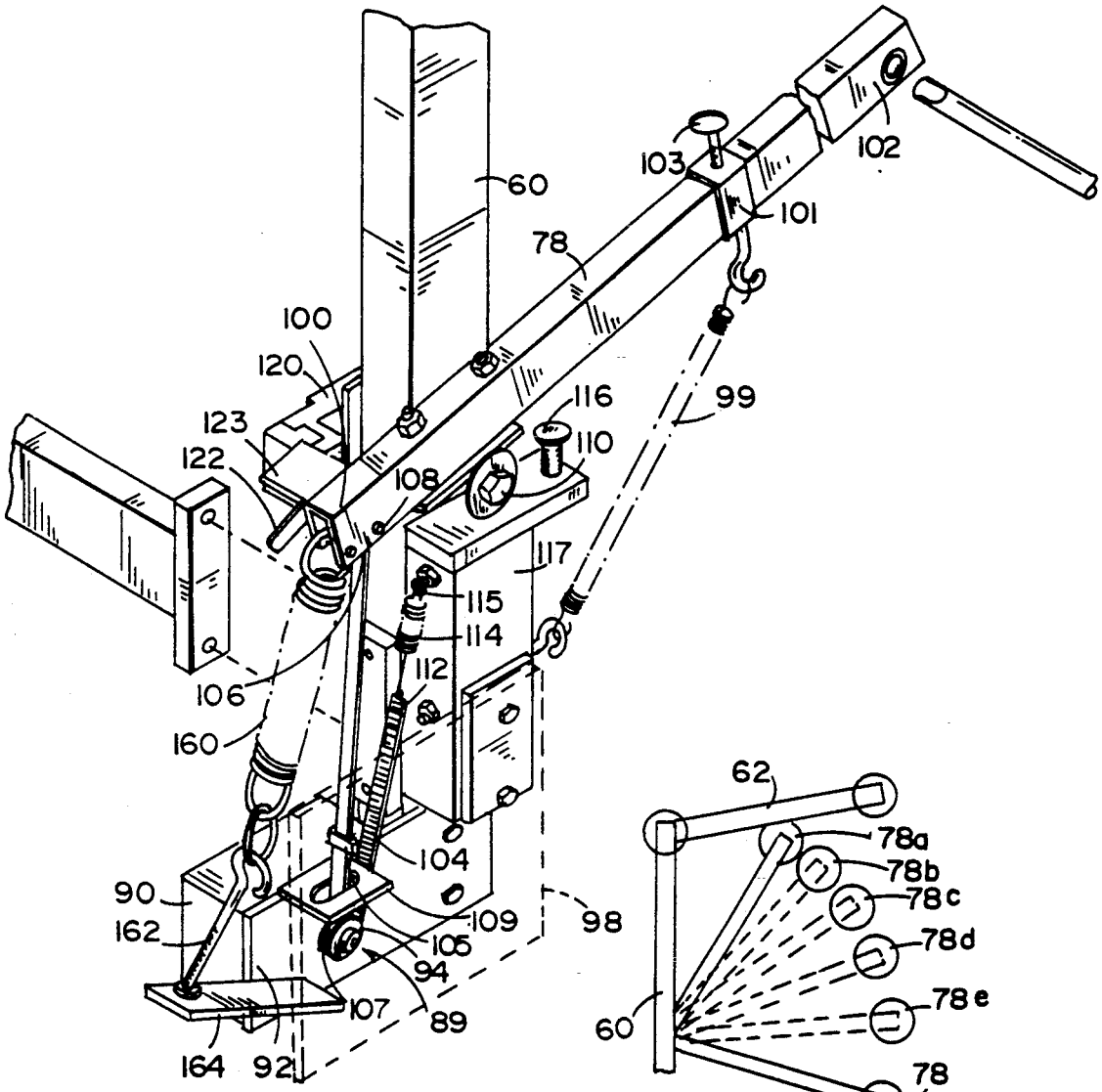
FIG. 2 is a perspective view of the improved control mechanism of the wire dispenser of the present invention.

The wire feed control mechanism includes a control potentiometer 90 mounted on the inner side of a plate 92 attached at a lower end of arm 60. A grooved pulley 94 (FIGS. 1 and 4) is mounted on an output shaft 96 of the potentiometer on the opposite side of the plate. A protector plate 98 is mounted over pulley 94 by appropriate bolts and spacers. For convenience, this plate is shown in phantom in FIG. 1 and is removed in FIG. 1A.

A ribbed timing belt 104 is wrapped at least partially around pulley 94 and has one end 106 attached to an eye bolt 108, which is in turn attached to arm 78 at a point spaced inward from an axle bolt 110, whereby arm 78 is pivotally mounted to arm 60 for upward rotation. This end of the timing belt is attached to the pivotable arm 78 at a point such that upward movement of the arm (indicative of a decreasing accumulation loop size) releases the tension on the timing belt and causes this end of the timing belt to move closer to the potentiometer.

The other end 112 of the timing belt is attached by an extension or return spring 114 to a bolt 115 on a fixed position member 117 of the frame. When the outer end of arm 78 is pivoted upwardly, the spring causes the timing belt to rotate the potentiometer to speed up the motor. The timing belt passes through a slot 107 in an obstruction plate 109, which is in turn attached to plate 92. A clip 105 is fastened to the timing belt above the obstruction plate and protrudes sufficiently far outwardly from the timing belt so that the clip engages obstruction plate 109 as the belt passes downwardly through the opening 107. Clip 105 can be two plastic plates fastened together on opposite sides of the timing belt. The clip limits the movement of the belt over the potentiometer in a downward direction. The position of the clip can be adjusted to provide any degree of potentiometer rotation before the clip stops the potentiometer from rotating further.

This control mechanism is an important feature of the present invention, because it enhances substantially the adjustability of control available with the present invention. With spring 114 pulling the timing belt over the potentiometer, instead of the arm pulling the belt over the potentiometer, the arm can be adjusted for maximum speed at almost any degree of pivotal movement and the arm can continue to move past that pivotal position without breaking the belt. For example, when arm 78 pivots upwardly, spring 114 causes the potentiometer to rotate until clip 105 stops further rotation. The arm can continue to rotate upwardly, however, and this only produces slack in end 106 of the timing belt. Thus, if there is a sharp intermittent pull on the wire when the motor is already operating at full speed, the intermittent demand can be taken up by further upward pivotal movement of the arm.

Figure 3:
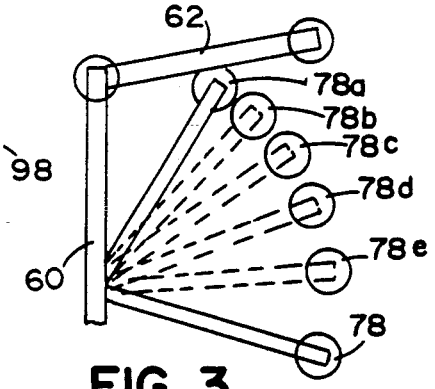
FIG. 3 is a schematic side elevational view of the wire accumulation device showing the effect of the use of different sizes of sprockets on the control potentiometer.
Figure 4:
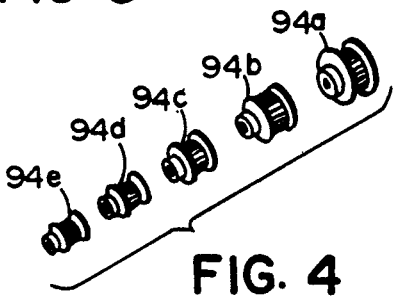
FIG. 4 is a perspective view showing several different sizes of timing pulleys that may be employed in the control potentiometer of the present invention.

With this construction, it is possible to change the amount of pivotal movement of the arm necessary to change the motor speed from a stopped condition to maximum speed by changing the size of sprocket 94 on the potentiometer. As shown in FIG. 4, sprocket 94 can be any one of various sizes, with the sprockets **94*a*–94*e* being arranged from the largest number of teeth or grooves to the smallest number of teeth. When sprocket 94*a* is mounted on the potentiometer, the degree of rotation of the potentiometer to achieve maximum motor speed is greater than the degree of rotation necessary to achieve maximum motor speed when a smaller sprocket, such as sprocket 94*e*, is used. The variation in arm movement between minimum and maximum motor speed is represented schematically in FIG. 3. With sprocket 94*a* mounted on the potentiometer, arm 78 may have to pivot all the way to position 78*a* to achieve maximum motor speed. The degree of rotation of arm 78 is successively smaller with each smaller sprocket until the minimum degree of pivotal movement, represented by arm position 78*e*, is achieved with sprocket 94*e*. Sprocket 94*e*** provides maximum sensitivity in motor speed control with variation in arm movement. In some applications this would be very desirable, while in other applications a larger degree of arm movement might be desirable.

The control mechanism of the present invention makes it possible to use these different sizes of sprockets to achieve different degrees of pivotal movement of the arm between minimum and maximum motor speeds while still permitting the arm to pivot to its maximum position before cutting off the motor with the limit switch. Even with the smallest sprocket **94*e*, after the arm has pivoted to position 78*e*, further pivotal movement of the arm merely causes the end 106** of the belt to become slack, and the belt is not stretched.

Figure 12:
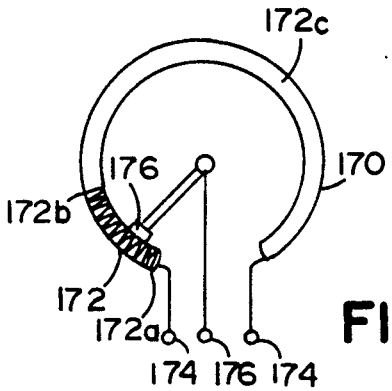
FIG. 12 is a schematic view showing a sixty (60) degree potentiometer of the type used for the FIG. 9 embodiment.

With this type of control mechanism, it is also possible to vary the degree of rotation of the arm between minimum and maximum speeds by using a different type of potentiometer. As shown in FIG. 12, instead of using a conventional three hundred forty (340) degree potentiometer (which provides for a proportionate variation in output signal through an arc of three hundred forty (340) degrees), a potentiometer having a smaller degree of variation can be employed. In FIG. 12 potentiometer 170 is a so-called sixty (60) degree potentiometer, with the variable resistance 172 extending through an arc of only sixty (60) degrees between maximum resistance point **172*a* and minimum resistance point 172*b*. When a rotating contact 176 is at position 172*a*, the resistance between points 174 and 176 is maximum, so the motor speed is minimum. As the contact slides between point 172*a* and the other end 172*b* of the variable resistance, the resistance between terminals 174 and 176 decreases to zero (0). Portion 172*c* of the rheostat has no resistance, so that after the contact passes point 172*b*, full voltage is applied between terminals 174 and 176**. Thus, the rheostat or potentiometer rotates between zero (0) and sixty (60) degrees in adjusting the output voltage between minimum and maximum. With this type of potentiometer, a much smaller degree of arm movement is necessary to change the motor speed from minimum to maximum. By selecting an appropriate size sprocket for the potentiometer output shaft and by selecting an appropriate potentiometer, wide variation is possible in the amount of arm movement that will occur between minimum and maximum motor operating speeds.

This is important, because the objective with any type of wire dispensing apparatus is to have the spool drive motor operating at substantially a continuous speed while permitting intermittent use of wire to be absorbed by the wire accumulation device. While constant feed back between the wire accumulation device and the motor will permit continuous adjustment in the motor speed, as the size and diameter of the wire coil decreases and for various other conditions, when properly adjusted, the motor drive should operate at a relatively constant rate of speed as wire is dispensed from the apparatus.

The use of a motor controller with a trim potentiometer 17 in series with the control potentiometer further enhances the adjustability of the present invention.

An adjustable position threaded stop bolt 116 limits the pivotal movement of arm 78 in a lower pivotal direction. A limit switch 120 actuated by an integral cam arm 122 is mounted to arm 60 in such a position that a flange 123 on pivoting arm 78 actuates the limit switch if, for some reason, the arm is pivoted upward to its maximum position. The limit switch can then deactuate the wire-using device that is connected to the dereeler.

The ease with which arm 78 is rotated is determined by the weight of the arm and by adjustment springs attached to the arm. A coil spring 99 extends from an eye bolt 98 attached to the lower end of arm 60 to a yoke or collar 101 adjustably mounted on arm 78. This spring urges the arm downwardly and hence makes the arm appear to be heavier than it is. The yoke can be repositioned by loosening lockbolt 103, sliding the yoke on the arm, and then retightening lock bolt 103, in order to change the tension on the spring.

Another coil spring 160 attached to the rear end of the pivotable arm 78 extends downwardly and is connected to an adjustable eye bolt 162 threaded in a plate 164 fixed to plate 92. By rotating the eye bolt the tension of this spring can be adjusted to lighten the pivotable arm and make it more responsive to changes in tension in the feed wire.

Wire is routed from the horizontal rotating table to the speed control mechanism 52 by means of a right angle control rod 126 rotatably mounted on arm 60 by vertical sleeves 128 or 129 (depending on the size of the wire coil) and held in place in the sleeve by collar 130. A horizontal section of rod 126 has a pair of wire guide fittings 132 and 134 attached to the rod by collars 136 and 138. The wire guide fittings comprise porcelain eyes mounted on mounting plates extending outwardly from the collars. The porcelain eyes serve as a convenient, low friction guide for directing wire from the horizontal spool upwardly to the pulley mechanism in a smooth curved path that minimizes deflection of the wire. Wire 150 coming from the spool extends through the porcelain eyes of wire guides 132 and 134 and then extends upwardly through one or both of additional wire guides 152 and 154 mounted toward the upper end of arm 60 by brackets 155 and 156. After passing through the wire guide, the wire is then looped around the pulleys and directed to the wire using equipment. The pulleys may be shifted from axle to axle and the wire may be wound around the pulleys in any desired configuration in order to position wire at a desired height or dispense wire in a given direction. One possible way of winding the wire around the pulleys is shown in FIG. 1.

In operation, the swing rod 126 pivots inwardly as wire is dispensed from the spool and causes a smooth transition of wire from the reel through the porcelain eyes to the pulley mechanism. The porcelain eyes provide an inexpensive yet effective and efficient low-friction guide mechanism for directing wire from the horizontal spools to the vertically oriented pulleys.

Figure 5:
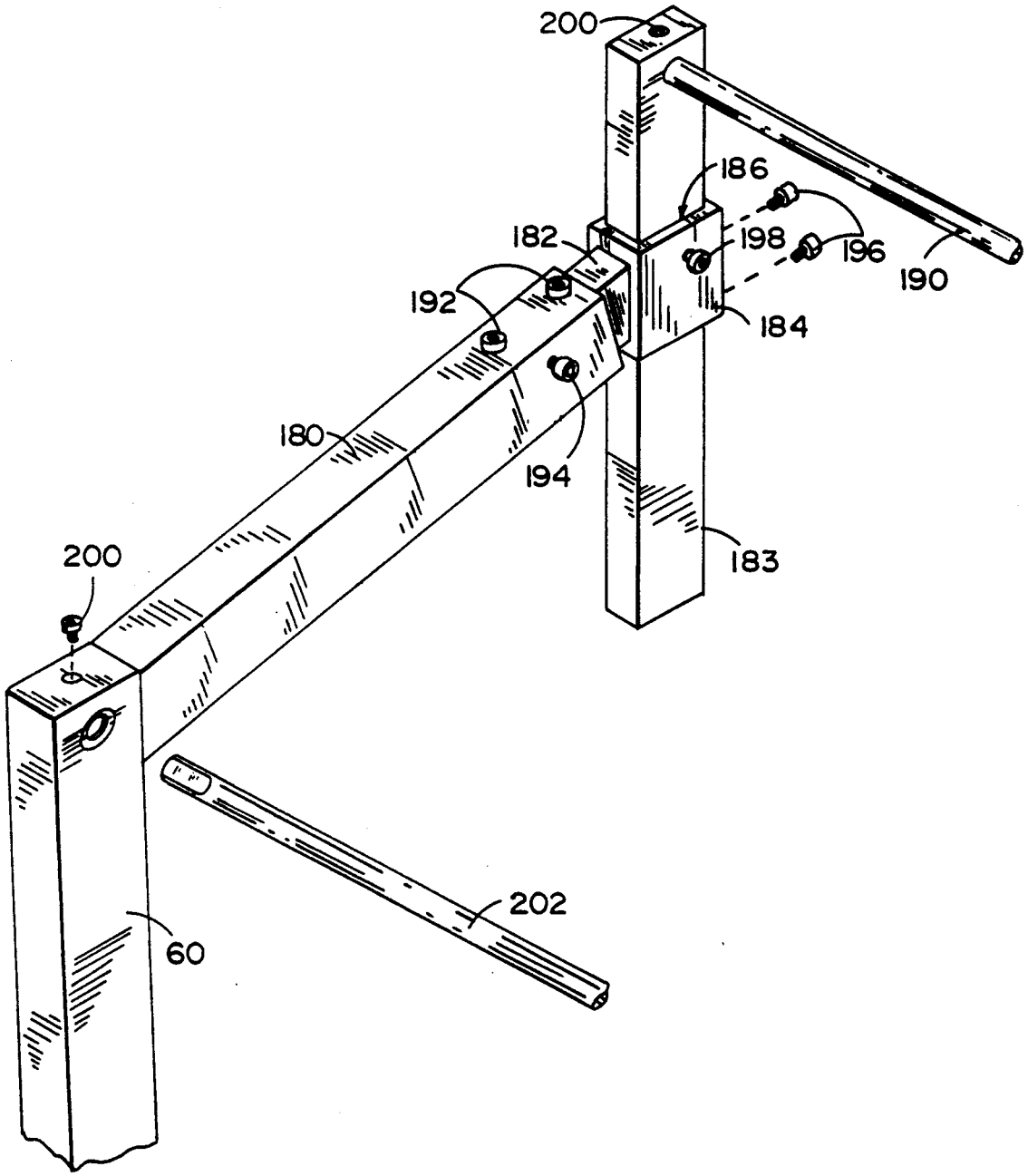
FIG. 5 is a perspective view showing an adjustable position fixed pulley arm for the present invention.

Additional adjustment capabilities of the present invention are shown in FIG. 5. In dispensing wire to a wire using device, it is frequently desired to have the wire dispensed from a particular vertical height. While some adjustment in height can be achieved by having the wire dispensed off different pulleys or by having the wire dispensed off the top or the bottom of the pulley, another means for adjustment of the height of the pulleys is shown in FIG. 5. In FIG. 5, vertical support arm 60 has an upwardly and outwardly inclined fixed arm 180 of a modified construction from fixed arm 62. Arm 180 has a hollow outer end and a telescoping portion 182 fits in the outer end of arm 180. A yoke 184 having a vertical opening of rectangular cross section 186 is welded or otherwise fastened to the outer end of arm 182. A vertical support arm 188 fits in opening 186. An axle 190 extends outwardly from the upper end of support arm 188.

Arm 182 is fastened in any desired position in arm 180 by means of set screws 192 and an alignment screw 194. Set screws 196 and an alignment screw 198 hold arm 188 in a desired position and orientation in yoke 184. As shown in FIG. 5, separate set screws 200 hold axles 190 and 202 in place in their support arms. The axles can thus be easily removed for replacement if they should become damaged.

Figure 6:
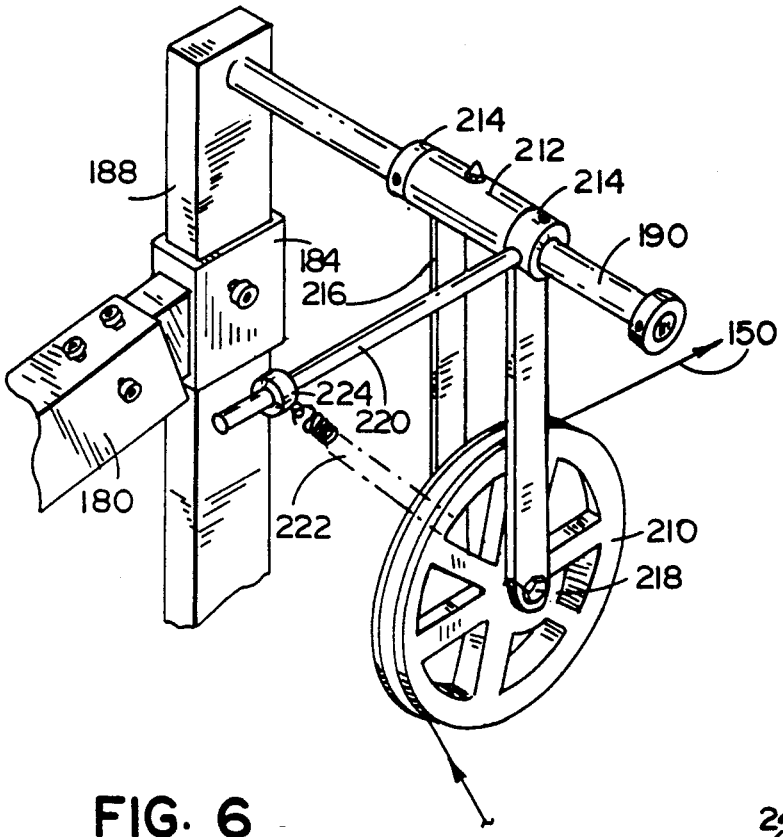
FIG. 6 is a perspective view of an improved feed pulley mechanism that dampens rapid intermittent oscillations in wire supply requirements.

When quick intermittent demands are made on the wire, it is sometimes desirable to accommodate this without constant pivotal movement of the arm 78. One way of accomplishing this in the present invention is by the use of pulley 210, shown in FIG. 6. Pulley 210 is mounted on axle 190 by means of a rotatable tubular housing 212, which is held axially in place by collars 214. Arms 216 extend downwardly from spaced locations on housing 212 on opposite sides of pulley 210. An axle 218 extending between the lower ends of arms 216 rotatably support pulley 210. A rod 220 extends rearwardly from collar 214 and is held in a fixed position. A collar 224 is mounted on the outer end of rod 220, and a spring 222 extends at an angle between collar 224 and the lower end of one of the arms 216. When wire 150 is rapidly jerked, pulley 210 pivots to the right (FIG. 6 orientation) against the resilient force of spring 222. Spring 122 then pulls the pulley back into its original position. If the pull on wire 150 is anything but a short, intermittent jerk, arm 78 pivots upwardly to make an appropriate adjustment in the motor control speed. The mounting mechanism for pulley 210 does not provide speed control but it does smooth out intermittent demands for wire.

Figure 7:
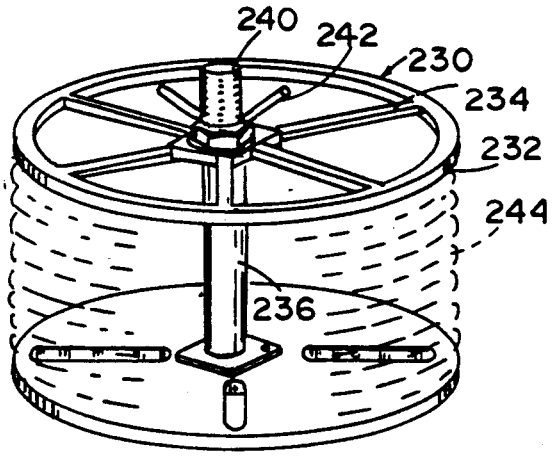
FIG. 7 is a perspective view of a hold-down ring and collar assembly for mounting a loose coil of wire on a horizontal wire table.

The rotating horizontal table of the present invention can be used for wire that is packaged in a wide number of configurations. When the wire is coiled loosely, the wire can be held in place by means of the hold-down ring 230 shown in FIG. 7. Hold-down ring 230 comprises an outer ring 232 connected together at a hub by means of spokes 234. The hub has an opening therethrough that receives a shaft 236 mounted on a table by means of a plate 238. The shaft has a threaded upper end 240. A large wing nut clamp 242 is threaded on shaft 240 in order to hold the ring firmly against the wire 244. The wing nut can be periodically tightened to hold the wire coil in place as the wire coil is dispensed from the rotating table.

Figure 8:
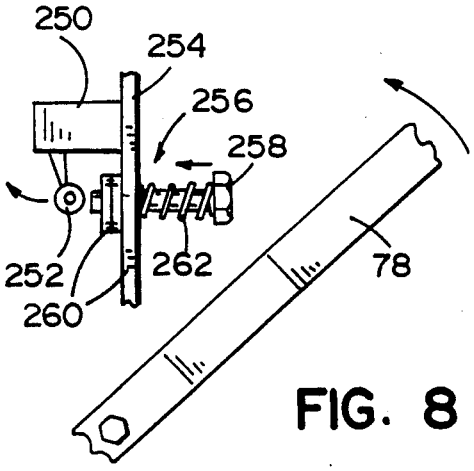
FIG. 8 is a pictorial view showing an improved limit switch assembly for controlling maximum movement of the dancer arm.

An improvement in a limit switch assembly is shown in FIG. 8. In this embodiment, a limit switch 250 having an integrally mounted pivoting cam arm 252 is mounted on a mounting plate 254. While this cam arm is actuated by the pivotal movement of arm 78, arm 78 does not directly engage the limit switch. Instead, a delay mechanism 256 is mounted in plate 254 and transfers the force of arm 78 to the limit switch. Delay mechanism 256 comprises a bolt 258 that fits through an opening in plate 254 and has threaded nuts 260 on an outer side of the plate and has a resilient spring 262 on the other side of the spring bearing on the head of the bolt. When arm 78 engages the head of bolt 258, the nut first compresses spring 262 before the bolt finally engages the limit switch to turn the apparatus off. The delay mechanism thus causes extra spring pressure to be exerted against arm 78 before the arm is permitted to engage the limit switch and turn off the apparatus. This extra spring force helps to urge the wire to become untangled if a temporary snag should cause the full pivotal movement of the pivoting arm. If the extra spring force is sufficient to remove the tangle, the mechanism stays in operation.

Figure 9:
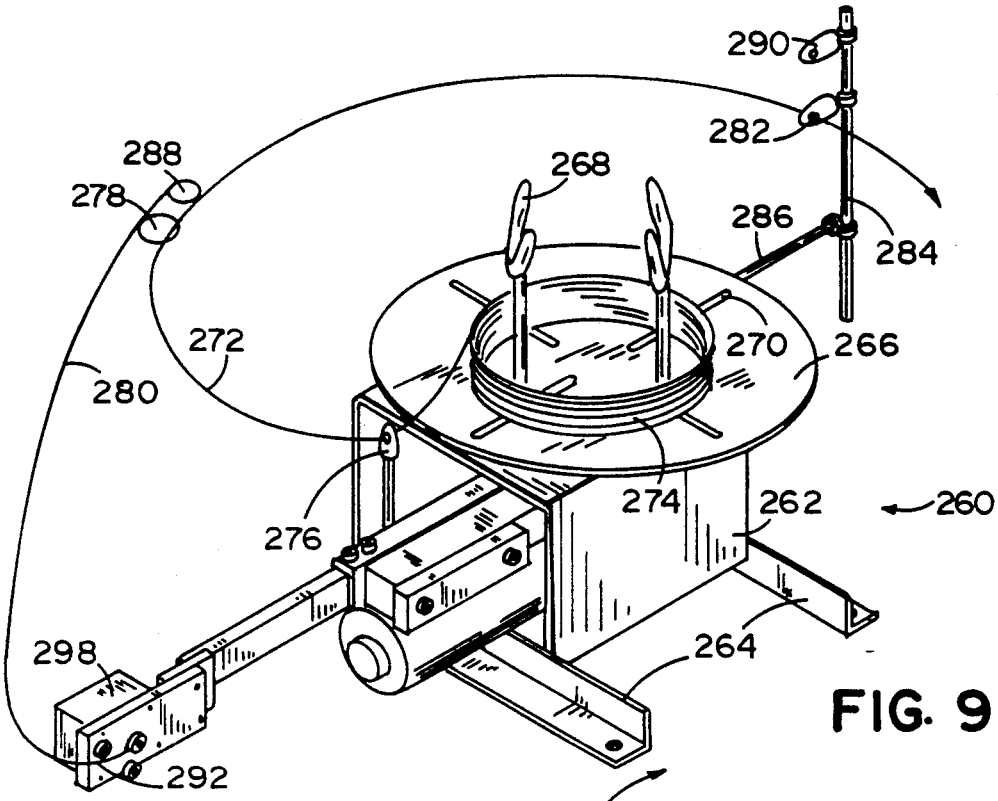
FIG. 9 is a perspective view of a light wire dispenser of the present invention.
Figure 10:
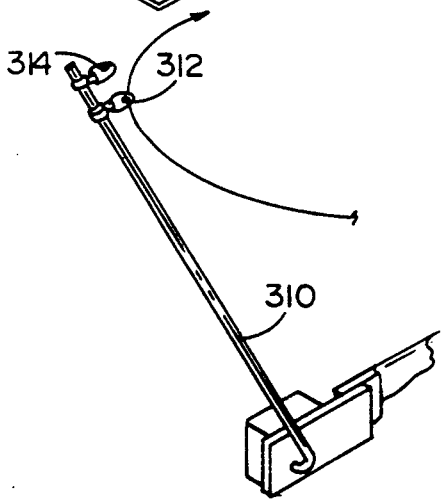
FIG. 10 is a perspective view of a portion of the light wire dispenser, showing the use of an alternative pivotal member for use with somewhat heavier wire.
Figure 11:
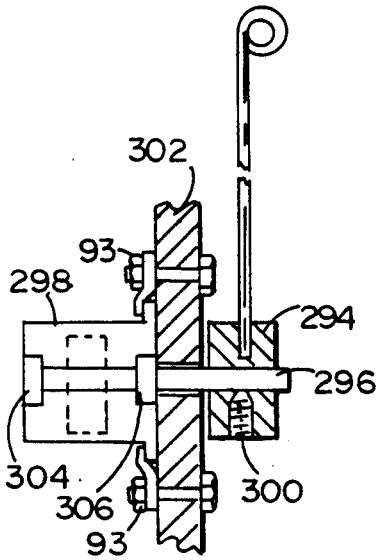
FIG. 11 is a cross-sectional view of the potentiometer assembly of FIG. 9.

Another embodiment of a wire dispenser in accordance with the present invention is shown in FIGS. 9-11. Wire dispenser 260 is particularly designed for especially light wire, of the type that might be used in medical spring applications or the like. With very light and precise wire, it is important not to stretch the wire, so it is especially critical to have a very even tension on the wire and a minimum amount of wire pull to change the speed of the drive motor. With dispenser 260, as little as one-quarter (¼) ounce can be effective in controlling the speed of the drive mechanism.

As in prior embodiments, dispenser 260 comprises a boxed-shaped frame 262 mounted on parallel rails 264. A rotating table 266 is mounted on the top of the frame, and rods 268 bolted in slots 270 serve as a guide for loosely coiled wire 272. The wire extends from the coil 274 on the table through a porcelain eye 276 and then extends through a loop 278 on the end of a light resilient spring wire 280. Wire 272 then extends through another porcelain eye 282 mounted on a vertical member 284 that is in turn mounted on a horizontal member 286. A second loop 288 in the wire and a second porcelain eye 290 mounted on member 284 are provided in the event that a double loop of wire is desired.

A second end 292 of wire member 280 is mounted in a collar. 294 that is in turn mounted on the output shaft 296 of a potentiometer 298 by means of a set screw 300. The potentiometer controls a motor controller as described above. The flex in the wire dampens rapid intermittent demands on the wire dispenser, while the potentiometer provides continuous motor speed adjustment.

With this construction, it can be seen that a sideways load is placed on the shaft of potentiometer 298 by wire device 280. Normally potentiometers are not designed to accommodate a sidewards load. While it would be possible to mount the output shaft of the potentiometer in a bearing mounted in plate 302, a bearing of this nature would still provide too much resistance to rotation of the potentiometer output shaft. Accordingly, it is significant that the potentiometer be provided with integral bearings 304 and 306 at opposite ends of the potentiometer housing and that the shaft 296 be mounted in these bearings. This provides a much lower resistance to rotation of the potentiometer output shaft and increases the sensitivity of the present apparatus.

As shown in FIG. 10, if the device of FIG. 9 is used for somewhat heavier wire, the metal loop can be replaced by a metal rod 310. The rod has porcelain eyes 312 and 314 mounted on it instead of loops in the rod, but otherwise the operation is similar.

Figure 13:
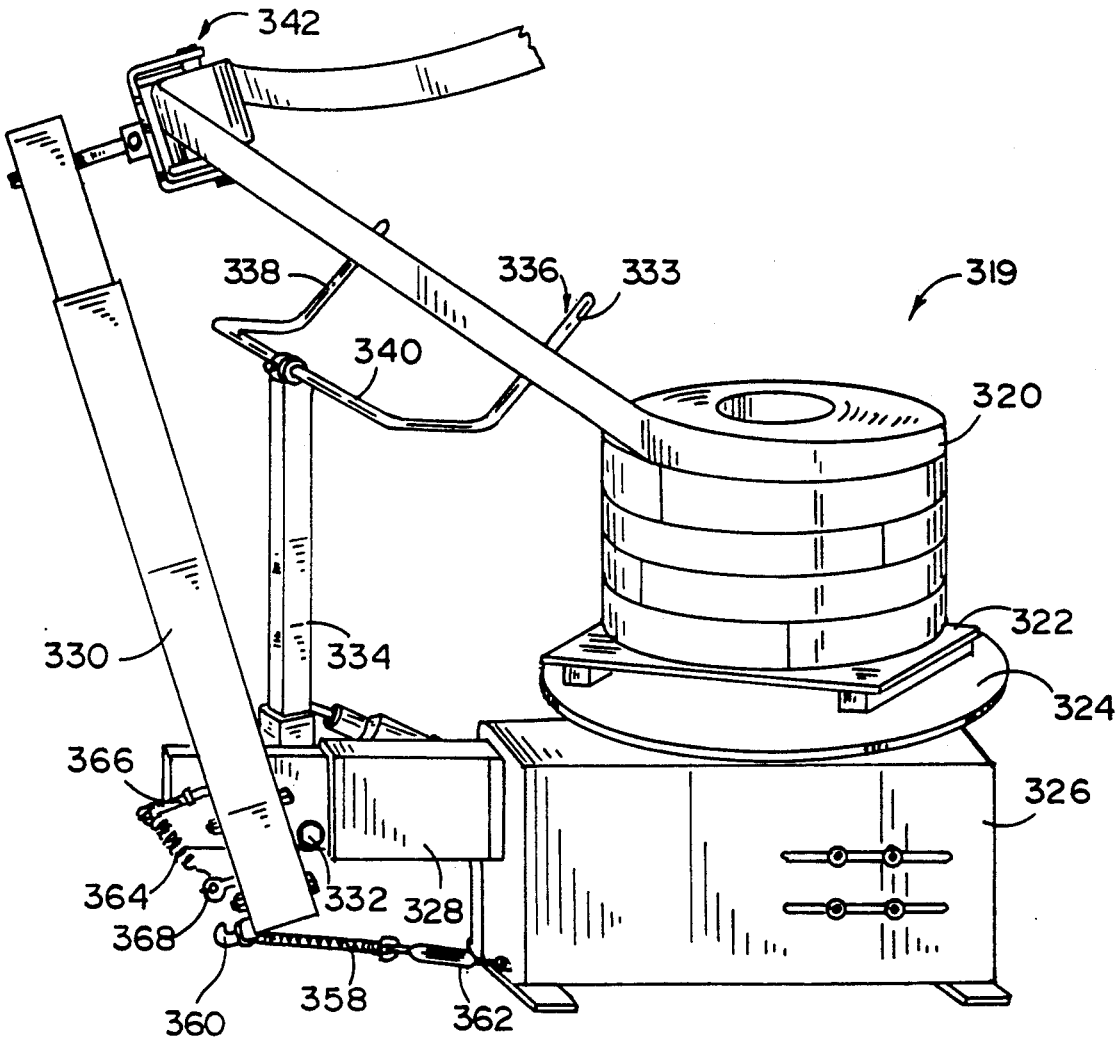
FIG. 13 is a perspective view showing another embodiment of the present invention wherein the wire is flat wire or wire strip.
Figure 14:
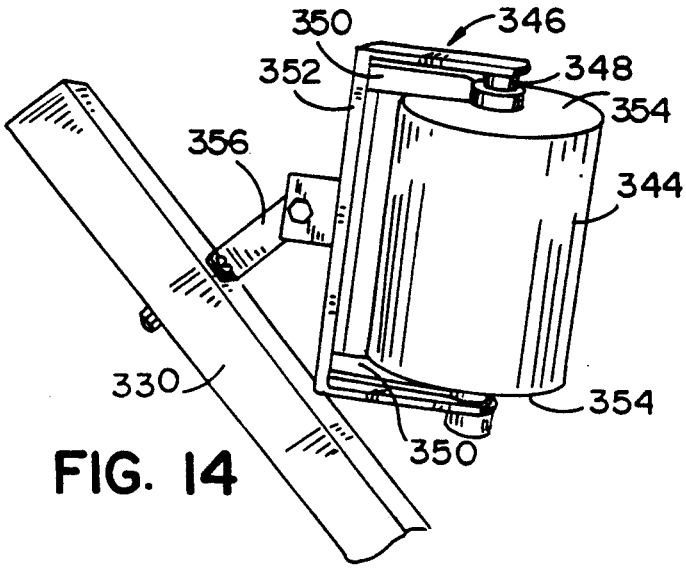
FIG. 14 is a perspective view showing the flat wire guide roller of FIG. 13.

The present invention is adaptable for all kinds of wire, including flat wire or wire strip. As shown in the embodiment 319 of FIG. 13, coils of flat metal strip 320 are stacked one on top of the other on a pallet 322, which is in turn placed on a rotating table 324 of the present invention. Rotating table is mounted on a base 326 of the type described previously. A telescoping mounting arm 328 extends horizontally outwardly from one end of the base. An upwardly extending telescoping support arm 330 is mounted on arm 328 by a pivot shaft 332 at the lower end thereof. A separate telescoping vertical arm 334 can be positioned inside of arm 330, and a U-shaped guide 336 comprising upwardly extending legs 338 and a base 340 is mounted on the upper end of support member 334. The legs on member 336 guide the strip material to a guide pulley mechanism 342, shown in more detail in FIG. 14. Guide pulley mechanism 342 comprises a wide nylon roller 344 rotatably mounted in a U-shaped support bracket 346 by means of an axle 348. The ends 354 of the nylon roller are abutted by metal rollers 350 pivotally mounted in a base 352 of the U-shaped support bracket. These rollers 350 are rotatable with the ends 354 of the nylon roller and hold the strip between the ends of the nylon roller. The support bracket is mounted to support member 330 by means of an angularly movable support bracket 356, which can be adjusted to provide the proper orientation of the roller for receiving and dispensing the strip materials.

With this apparatus, wire strip can be fed from coils to appropriate machinery without bending or kinking the strip material.

As in prior embodiments, the tension on arm 330 can be adjusted by means of a pair of springs that pull the arm in opposite directions. A spring 358 serves to increase the weight or tension of arm 330. This spring is attached to the lower end of arm 330 at a position below its pivot point, with one end of the spring being attached to an eye bolt 360 on the lower end of the arm and the other end of the spring being attached to the base through a turnbuckle 362. The turnbuckle can be adjusted in order to vary the tension of the spring. An arm lightening spring 364 is attached to an eye bolt 366 mounted on the frame and an eye bolt 368 mounted to arm 330. This spring urges the arm 330 to the right (FIG. 13 orientation), thus lightening the tension on the strip caused by arm 330. By adjusting the relative tensions of both of these springs and particularly by adjusting the turnbuckle 362, a proper degree of tension on the arm to accommodate a particular weight or strip material can easily be achieved.

The foregoing is merely representative of the preferred embodiments of the present invention. Various changes in the construction of these embodiments may be made without departing from the spirit and scope of the present invention, which is defined in the appended claims.

I claim:

1. A variable speed, motorized wire dispenser for automatically dispensing wire from a coil of wire to a wire using machine under variable wire feed rate conditions comprising:

a frame including support means for rotatably supporting the wire for dispensing wire to the wire using machine in a predetermined direction;

an electric motor mounted in the frame so as to rotate the coil of wire;

a motor controller that produces an electrical output that controls the operation of the electric motor;

wire accumulation means mounted in the frame for producing an accumulation loop of wire to supply or store wire under rapidly changing demand conditions, the wire accumulation means comprising a wire engaging guide movably positioned in the frame such that wire extends over the guide in extending from the wire coil to the predetermined direction, the guide being movable in relation to the predetermined direction so as to produce an accumulation loop in the wire, the guide being biased to increase the accumulation loop between predetermined limits, the guide being mounted at one end of a movable arm which is movably mounted to the frame at a point removed from the guide; and control means responsive to the position of the guide for generating a continuously variable electric control signal representative of guide position, the control signal being transmitted to the motor controller so as to produce a change in motor speed, the control means causing the motor to decrease the rate of wire feed as wire supply requirements decrease and increase the rate of wire feed as wire supply requirements increase, the control means comprising a rotary potentiometer having an output shaft, with a drive sprocket being mounted on the output shaft, the potentiometer being rotated to change the control signal, the potentiometer being rotated by a drive belt wrapped at least partially around the drive sprocket, the belt having one end attached to the frame through a resilient tension device and having another end attached to the arm, the end attached to the arm being mounted such that the arm releases tension on the belt as the arm moves to a position indicative of a smaller accumulation loop, the resilient tension device pulling the belt over the potentiometer sprocket in such a manner as to increase speed when tension is released in such manner, stop means being mounted on the belt for stopping movement of the belt over the potentiometer so as to limit the rotation of the potentiometer to a predetermined maximum amount indicative of the highest wire feed rate desired, further arm movement in the direction of a decreasing loop producing no further belt induced potentiometer rotation and consequently no further motor speed increase after the belt movement has been stopped by the stop means.

2. A wire dispenser according to claim 1 wherein the belt passes a fixed member as it moves over the potentiometer and the stop means comprises a clip that is releasably mountable on the belt at a desired location, the clip protruding outwardly from the belt so as to engage the fixed member and stop further movement of the belt over the potentiometer as the clip moves adjacent the fixed member.

3. A wire dispenser according to claim 1 wherein the control means further comprises a limit switch for deactuating the motor after the arm has moved a predetermined maximum amount in decreasing the size of the accumulation loop, the wire dispenser further including a lost motion actuator delay mechanism mounted in the frame separate from the limit switch, the delay mechanism being engaged by the movable arm and the delay mechanism in turn engaging the limit switch to shut off the motor only after the delay mechanism has been moved a predetermined amount, the delay mechanism being resiliently biased against such movement such that the delay mechanism produces a yieldable force against the movable arm that resists engagement of the limit switch and urges disengagement of wire tangles.

* * * * *